US012004604B2

(12) United States Patent
Broce et al.

(10) Patent No.: US 12,004,604 B2
(45) Date of Patent: Jun. 11, 2024

(54) SELECTIVELY ATTACHABLE GARMENT-TO-APPENDAGE INTERFACE

(71) Applicant: Battelle Memorial Institute, Columbus, OH (US)

(72) Inventors: Stephanie M. Broce, Salem, VA (US); Douglas E. Wilke, Columbus, OH (US); Timothy C. Rothwell, Columbus, OH (US); Michael A. Lorenz, Columbus, OH (US); Emily K. Stokes, Columbus, OH (US)

(73) Assignees: Battelle Memorial Institute, Columbus, OH (US); Secretary Of The U.S. Army, Offutt, NE (US)

( * ) Notice: Subject to any disclaimer, the term of this patent is extended or adjusted under 35 U.S.C. 154(b) by 0 days.

(21) Appl. No.: 17/351,623

(22) Filed: Jun. 18, 2021

(65) Prior Publication Data

US 2021/0393000 A1 Dec. 23, 2021

Related U.S. Application Data

(60) Provisional application No. 63/040,878, filed on Jun. 18, 2020.

(51) Int. Cl.
*A44B 17/00* (2006.01)
*A41D 1/00* (2018.01)

(52) U.S. Cl.
CPC ..... *A44B 17/0041* (2013.01); *A41D 1/00* (2013.01); *A41D 2300/324* (2013.01)

(58) Field of Classification Search
CPC .... A41D 1/00; A41D 13/0005; A41D 13/001; A41D 13/055; A41D 13/0556; A41D 13/088; A41D 13/11; A41D 13/1161; A41D 13/1176; A41D 13/1227; A41D 17/005; A41D 19/0044; A41D 19/0048; A41D 2300/324; A44B 17/0041; A44B 17/007; A62B 17/001; A62B 17/04
USPC ..... 2/270, 16
See application file for complete search history.

(56) References Cited

U.S. PATENT DOCUMENTS

| | | | |
|---|---|---|---|
| 1,117,077 | A | 11/1914 | Mooney |
| 2,487,400 | A | 11/1949 | Tupper |
| 3,747,126 | A | 7/1973 | Hoagland |
| 3,889,297 | A | 6/1975 | Jarboe et al. |
| 4,766,613 | A | 8/1988 | Wells |
| 4,918,754 | A | 4/1990 | Heller, Jr. |
| 5,182,812 | A | 2/1993 | Goldsby |
| 5,749,098 | A | 5/1998 | Evans |
| 5,909,801 | A | 6/1999 | Coffman |

(Continued)

FOREIGN PATENT DOCUMENTS

| | | | |
|---|---|---|---|
| JP | 2002173809 | A | 6/2002 |
| WO | 2006075989 | A1 | 7/2006 |

*Primary Examiner* — Jameson D Collier
*Assistant Examiner* — Matthew R Marchewka
(74) *Attorney, Agent, or Firm* — Grossman, Tucker, Perreault & Pfleger PLLC; Donald J. Perreault

(57) ABSTRACT

A selectively attachable garment-to-appendage interface including a seal having a first portion to a garment and a second portion coupled to an appendage such as a glove, a hood or footwear. The first portion includes one of a projection or a groove. The second portion includes the other of the projection or a groove. The projection and the groove are configured to releasably engage for selectively attaching the garment to the appendage.

20 Claims, 11 Drawing Sheets

(56) References Cited

U.S. PATENT DOCUMENTS

| | | | | |
|---|---|---|---|---|
| 6,092,235 | A | 7/2000 | Santa Cruz et al. | |
| 6,715,159 | B2 | 4/2004 | Cormier | |
| 7,051,374 | B1 | 5/2006 | Grilliot et al. | |
| 8,726,415 | B2 | 5/2014 | Grilliot et al. | |
| 8,856,965 | B1 | 10/2014 | Theofield | |
| 2012/0066810 | A1 | 3/2012 | Marcus | |
| 2014/0130233 | A1 | 5/2014 | Horton | |
| 2018/0255846 | A1 | 9/2018 | Ferro et al. | |
| 2018/0279695 | A1* | 10/2018 | Axelsson | B63C 11/04 |
| 2019/0274375 | A1* | 9/2019 | Brown | B63C 11/04 |
| 2020/0146374 | A1 | 5/2020 | Thompson | |
| 2021/0196007 | A1* | 7/2021 | Haugen | A41D 13/0005 |
| 2021/0196009 | A1* | 7/2021 | Haugen | A41D 13/0005 |
| 2021/0282471 | A1* | 9/2021 | Musgrove | A41D 19/0089 |

* cited by examiner

SELECTIVELY ATTACHABLE GARMENT-TO-APPENDAGE INTERFACE

CROSS-REFERENCE TO RELATED APPLICATIONS

The present application claims the benefit of the filing date of U.S. Provisional Application Ser. No. 63/040,878, filed Jun. 18, 2020, the entire teachings of which are hereby incorporated herein by reference.

STATEMENT REGARDING FEDERALLY SPONSORED RESEARCH OR DEVELOPMENT

This invention was made with government support under Contract No. FA8075-14-D-0003, DO 0003 awarded by the United States Air Force. The government has certain rights in the invention.

TECHNICAL FIELD

The present application relates to generally to garments and, more particularly, to a selectively attachable garment-to-appendage interface.

BACKGROUND

Known garments may include: a jacket with a collar, sleeves and cuffs; and pants with legs and cuffs. The jacket and pants may be provided as separate articles or combined into a whole-body garment. Gloves, headwear and/or footwear may be provided as separate components.

Garments adapted for extreme or hazardous environments may include structures for providing a selectively attachable seal between the cuffs and/or collar of a garment and associated gloves, footwear and/or headwear. A hazardous materials suit (commonly referred to as a hazmat suit), for example, is a whole-body garment worn as protection against hazardous materials. Hazmat suits are used by firefighters, emergency medical technicians, paramedics, researchers, personnel responding to toxic spills, specialists cleaning up contaminated facilities, and workers in toxic environments. A secure and selectively attachable connection between the cuffs of a hazmat suit and gloves or footwear and/or the collar of a hazmat suit and headgear, such as hood, facilitates donning of the suit by a user while providing protection from hazardous materials.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
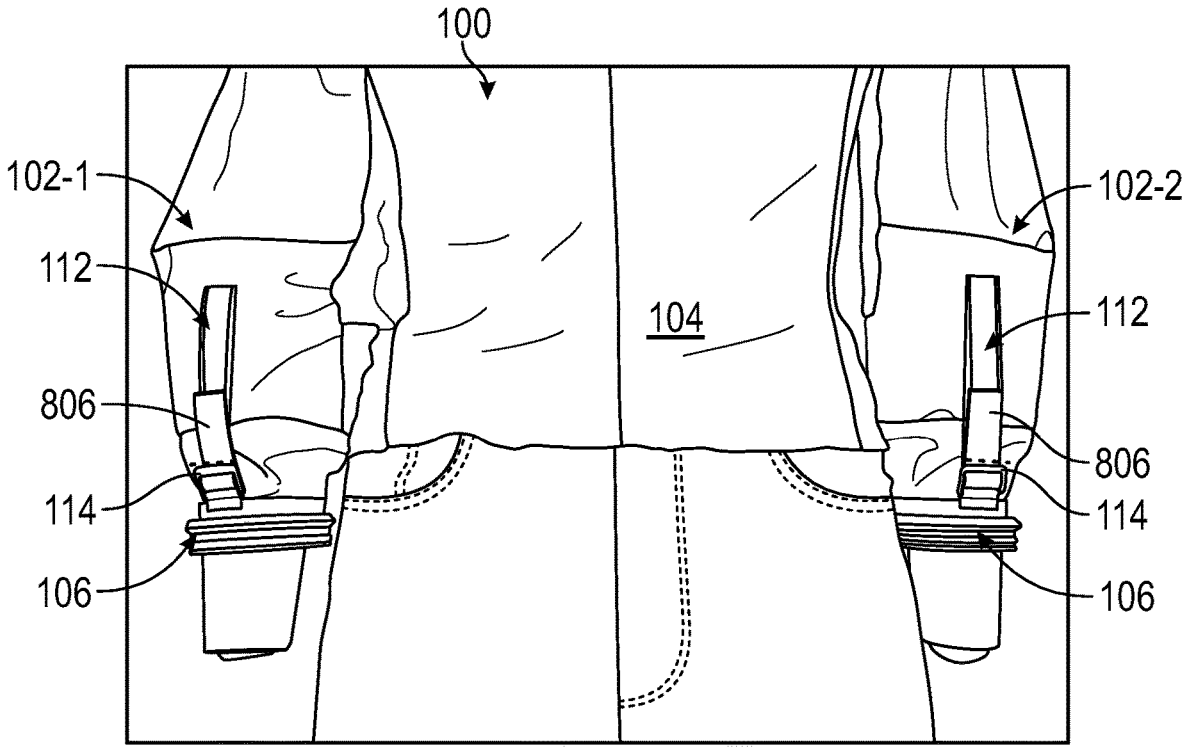
FIG. 1 is a front view of a mannequin wearing a garment with one example of a first portion of a seal consistent with the present disclosure.

The present disclosure is not limited in its application to the details of construction and the arrangement of components set forth in the following description or illustrated in the drawings. The examples described herein may be capable of other embodiments and of being practiced or being carried out in various ways. Also, it may be appreciated that the phraseology and terminology used herein is for the purpose of description and should not be regarded as limiting as such may be understood by one of skill in the art. Throughout the present description, like reference characters may indicate like structure throughout the several views, and such structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable, and not exclusive.

A garment-to-appendage interface consistent with the present disclosure includes a first portion and a second portion. One of the first portion and second portion includes a projection and the other of the first and second portion includes a groove. A seal is made between the first and second portions by inserting the projection into the groove. As used herein a "garment" means an article of clothing that may be donned by a user including, for example, a coat, jacket, shirt, pants, or a whole-body suit. As used herein an "appendage" means any article of clothing that may be donned by a user to at least partially cover a user's hands, feet or head. Although example embodiments described herein may be described in the context of a garment cuff-to-glove interface or a garment collar-to-hood interface, the interface used in the examples may be used to connect the garment with any appendage. Also, although embodiments of the present disclosure may be described herein in connection with a first portion of the selectively attachable seal coupled the garment and a second portion selectively attachable seal coupled to the appendage, the orientation of the first and second portions may be reversed so that the first portion is attached to the appendage and the second portion is attached to the garment.

Figure 2:
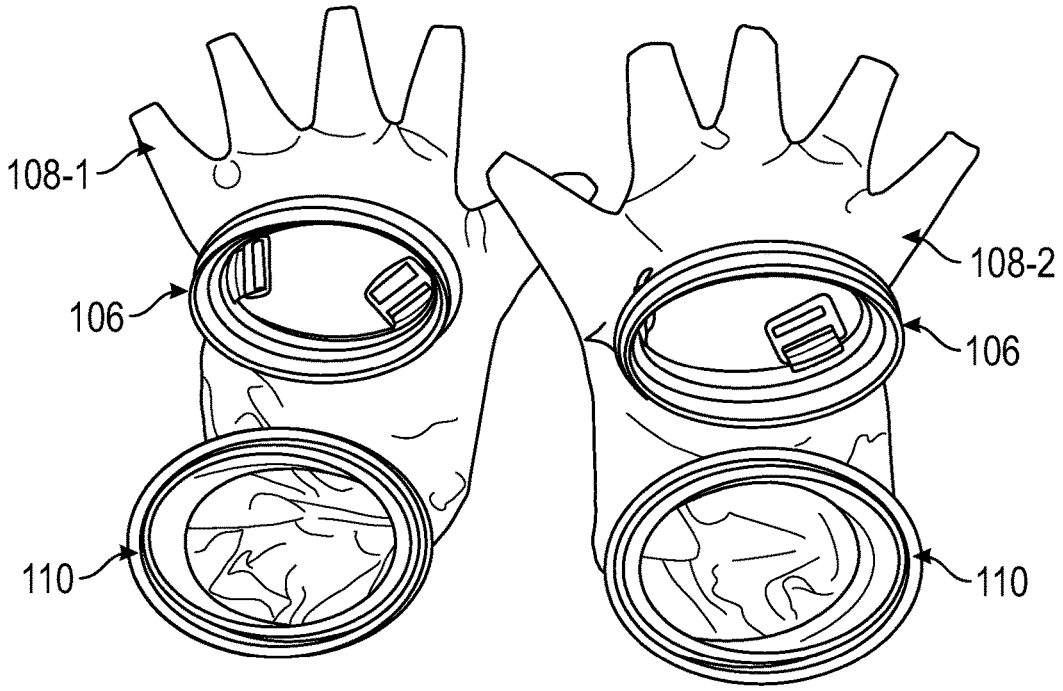
FIG. 2 is perspective view of gloves having one example of a second portion of a seal consistent with the present disclosure coupled thereto and a first portion of a seal consistent with the present disclosure resting on the gloves.

Turning to FIG. 1, there is illustrated a garment 100 positioned on a mannequin. The garment is configured as jacket with sleeves 102-1, 102-2 and a torso portion 104. Each sleeve 102-1, 102-2 has a first portion 106 of a seal consistent with the present disclosure coupled to an associated cuff. FIG. 2 illustrates the first portions 106 unattached to, but resting on, associated gloves 108-1, 108-2. Each of the gloves 108-1, 108-2 has a second portion 110 of a seal consistent with the present disclosure coupled to the end of the glove 108-2, 108-2 defining the opening for receiving the hand of a user. In general, a user wearing the garment 100 with the first portions 106 coupled to the cuffs thereof may don the gloves 108-1, 108-2 by coupling the first portions 106 to associated second portions 110 coupled to the gloves 108-1, 108-2. Coupling of the first 106 and second 110 portions provides a seal therebetween to resist or prevent ingress of hazardous materials between the cuffs of the garment 100 and the gloves 108-1, 108-2, while allowing facile and selective attachment of the gloves 108-1, 108-2 to the garment 100.

Figure 3:
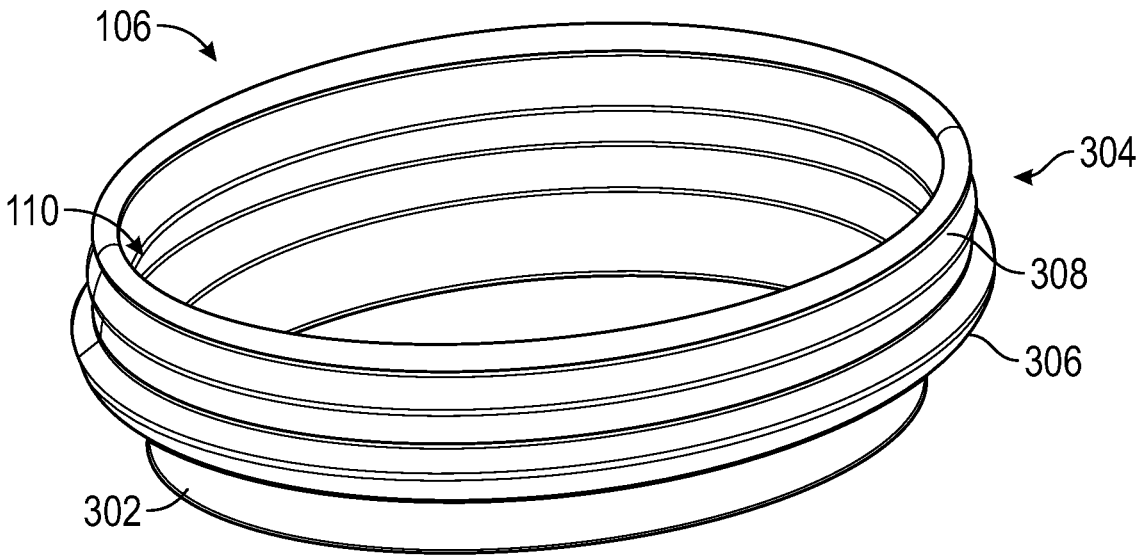
FIG. 3 is a perspective view of the first potion of the seal shown in FIG. 1.
Figure 4:
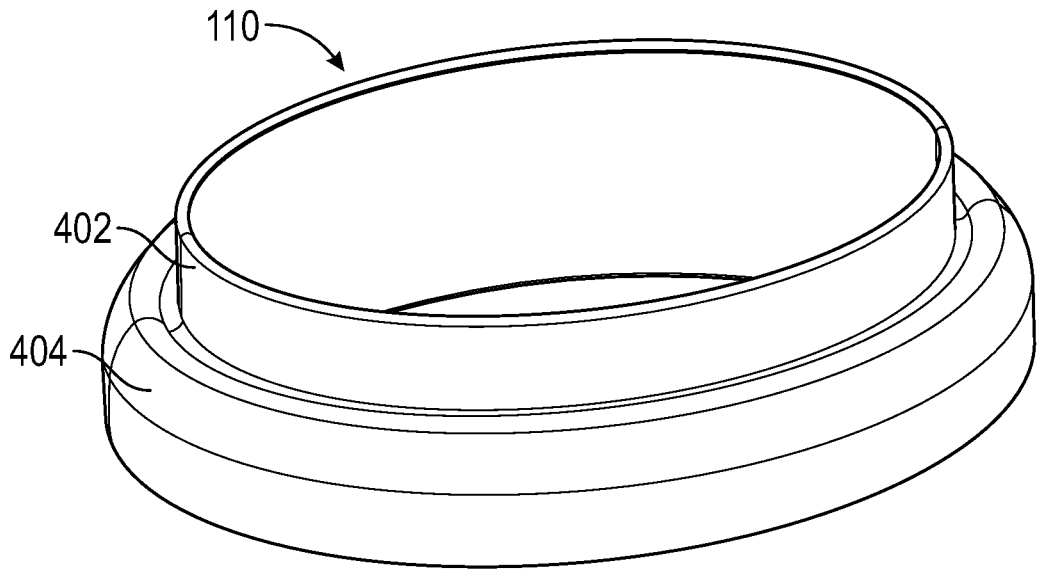
FIG. 4 is perspective of a second portion of the seal shown in FIG. 2.

FIG. 3 illustrates one example of the first portion 106 of the seal shown attached to the cuffs of the garment 100 in FIG. 1. The illustrated example embodiment of the first portion 106 includes a flange 302 and an extension 304 including a base 306 and a projection 308. The flange 302 is configured to interface with the cuff of a garment and may be sewn or bonded to the cuff. FIG. 4 illustrates one example of the second portion 110 of the seal shown attached to the gloves 108-1, 108-2 in FIG. 2. The illustrated example embodiment of the second portion 100 includes a flange 402 and an extension 404. The flange 404 is configured to interface with the opening of an appendage, e.g., a glove 108-1, 108-2 as shown in FIG. 2, and may be sewn or bonded to the glove 108-1, 108-2 at the opening thereof. The extension 404 defines a groove, as will be described herein, for receiving the projection 308 of the first portion 106. The first 106 and second 110 portions may each be constructed of a resilient material, such as plastic or rubber.

Figure 5:
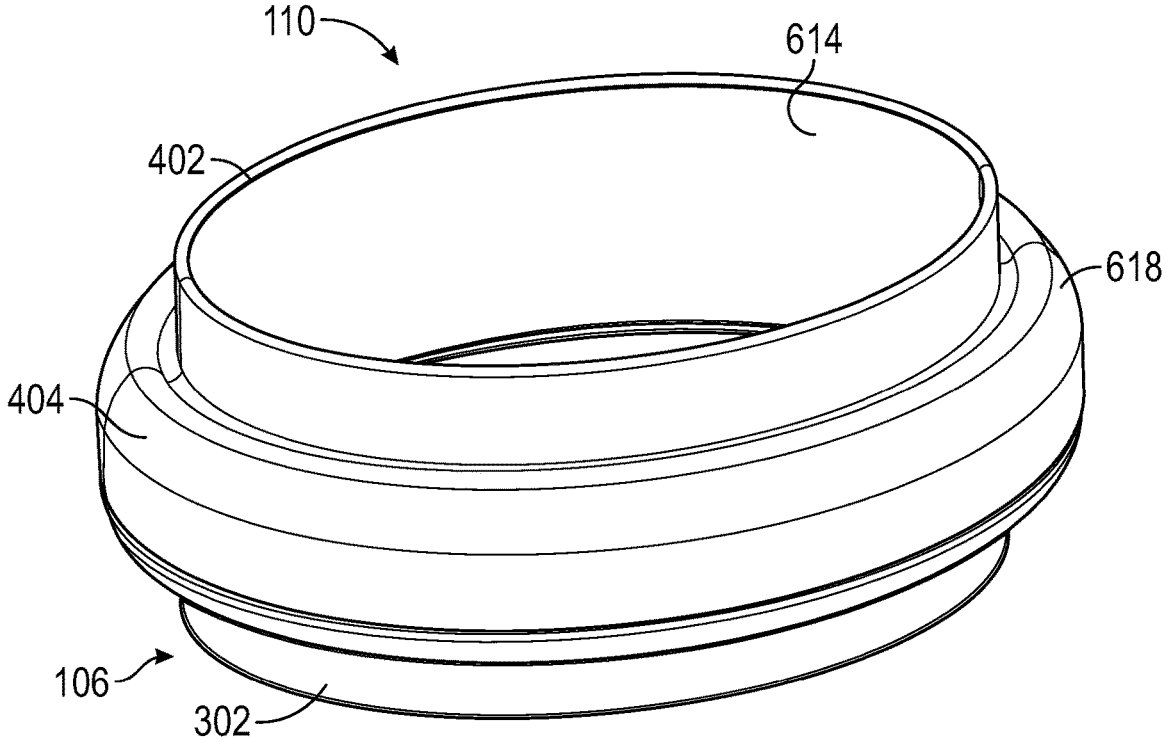
FIG. 5 is perspective of one example of a completed seal consistent with the present disclosure.
Figure 6:
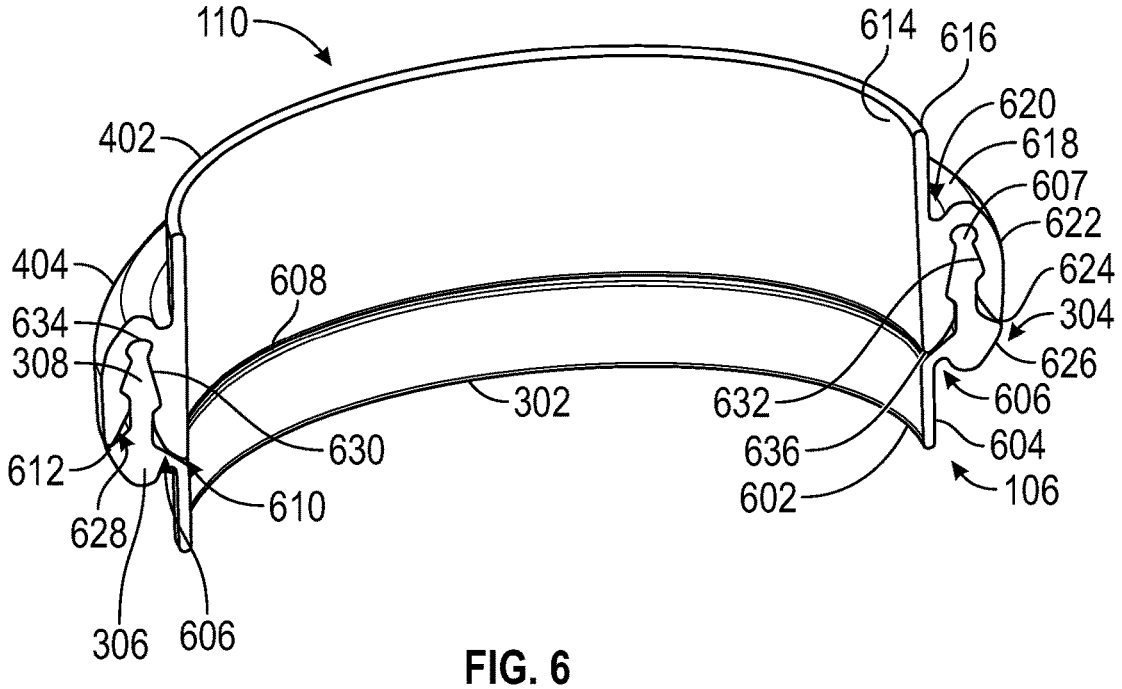
FIG. 6 is perspective sectional view of the seal shown in FIG. 5.

FIG. 5 is a perspective view, and FIG. 6 is a sectional view, of the first 106 and second 110 portions of the seal in an assembled and sealed configuration. In the illustrated example, the flanges 302, 402 of the first 106 and second 110 portions are generally cylindrical. The flange 302 of the first portion 106 has an inner surface 602 and an outer surface 604. The extension 304 includes has an arm 606 extending radially outwardly from an upper portion of the flange 302 to the base 306. The base 306 extends downwardly (in the orientation shown in FIG. 6) to define a first perimeter groove 606 between the base 306 and the outer surface 604 of the flange 303 for receiving an end of the cuff of the sleeve. The projection 308 extends upwardly from the base portion 306, e.g., in a direction generally parallel to an axis of the cylindrical flange 302 and terminates in a tip 607. In the illustrated example the tip 607 is configured as a rounded bead. The projection 308 is spaced from an upper rim 608 of the flange 302 by the arm 606 to define an inner groove 610 between the flange 302 and the extension 304, i.e., between the upper portion of the flange 302 and the base 306 and projection 308. The base 306 extends radially outward from a bottom of the projection 308 to define an outer shoulder 612.

The flange 402 of the second portion 110 includes an inner surface 614 and an outer surface 616. The extension extends radially from the flange 402 to a rim 618. The rim 618 extends upwardly (in the orientation shown in FIG. 6) to define a perimeter groove 620 between the rim 618 and the outer surface 616 of the flange 402 for receiving an open end of the glove 108-1, 108-2. The extension 404 includes a curved outer surface 622 arcing outwardly from the rim 618 and downward to a tip 624. The tip 624 is positioned in opposed facing relationship to the shoulder 612 of the first portion 106 so that outer surface 622 is substantially aligned with and smoothly transitions to an outer surface 626 of the base 306, e.g., without presenting an abrupt transition that can catch on items external to the seal. In some embodiments, the external diameter of the second portion 110 at the tip 624 is substantially the same as the external diameter of the first portion 106 at the shoulder 612 and the first 106 and second 110 portions are positioned concentrically.

The extension 404 further includes a groove 628 defined between first 630 and second 632 interior walls that meet at a rounded end 634. The first interior wall 630 meets the interior surface 614 of the flange 402 at a tip 636 configured to be disposed in the inner groove 610 so that the interior surface 614 of the flange 402 is substantially aligned with and smoothly transitions to the interior surface 602 of the flange 302, e.g., without presenting an abrupt transition that can catch on items external to the seal. In some embodiments, the internal diameter of the second portion 110 at the tip 636 is substantially the same as the internal diameter of the first portion 106 and the first 106 and second 110 portions are positioned concentrically. The second interior wall 634 meets the exterior surface of the extension 404 at the tip 624.

Figure 7:
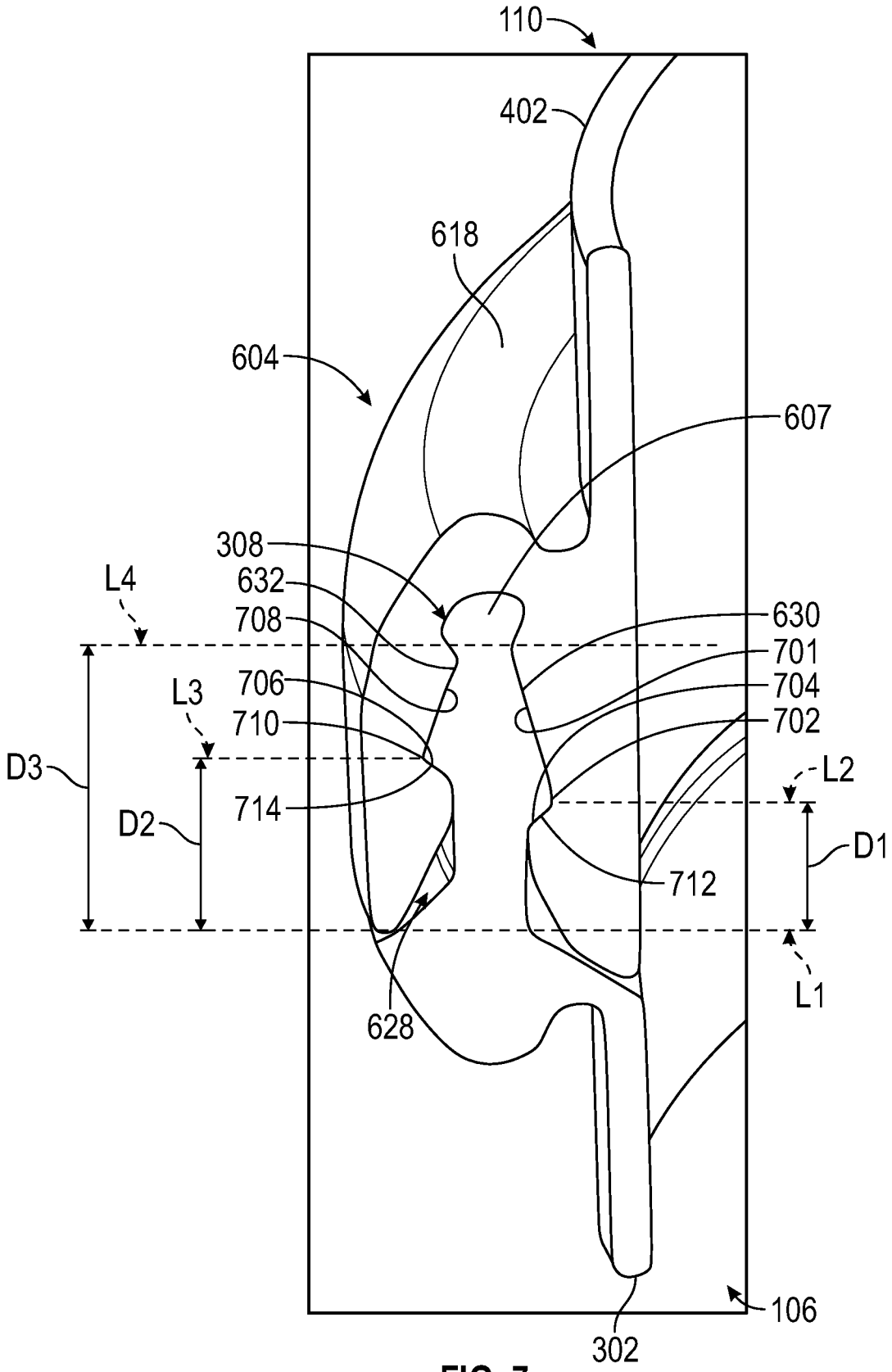
FIG. 7 is detailed view of a portion of FIG. 6.

With reference to FIG. 7, the projection 308 of the first portion 106 extends upwardly then radially inward from an interior surface 701 of the projection 308 to a tip 702 of a first shoulder 704. The tip 702 of the first shoulder 704 is positioned at a distance D1 measured from a first line L1 parallel with a radius line of the first portion 106 and intersecting the bottom of the projection 308 and a second line L2 parallel to the first line L1 and intersecting a bottom of the tip 702. A second shoulder 706 extends radially outward from an exterior surface 708 of the projection 308 to a tip 710. The tip 710 of the second shoulder 706 is positioned at a distance D2 measured from the first line L1 parallel to a third line L3 parallel to the first line L1 and intersecting a bottom of the tip 710. The distance D2 is greater than the distance D1.

From the tips 702 and 710 the interior surface 701 and the exterior surface 708 of the projection converge to the tip 607 of the projection 308. The base of the tip 607 of the projection is positioned at a distance D3 measured from the first line L1 parallel to a fourth line L4 parallel to the first line L1 and intersecting a base of the tip 607. The distance D3 is greater than the distance D1 and the distance D2.

The first interior wall 630 of the groove 628 defines a first shelf 712 and the second interior wall 632 defines a second shelf 714. The first 712 and second 714 shelves are positioned to be in contact with and in opposed facing relationship to the first 704 and second 706 shoulders of the projection 308 when the projection 308 is disposed in the groove 628 with the tip 607 of the projection 308 disposed in opposed facing relationship and in contact with the rounded end 634 of the groove 628. With this configuration, the projection 308 may be inserted into the groove 628 with the projection engaging and pushing against the interior walls 630, 632 to open the groove 628 for receiving the projection 308. When the tip of 607 of the projection is positioned against the rounded end 634 of the groove 628, the groove 628 flexes inward to position the shelves 712, 714 against the shoulders 704, 706, respectively, to releasably hold the projection 308 in the groove 628. The first portion 106 and the second portion 110 thus allow selective attachment of a sleeve 102-1, 102-2 of the jacket to a glove 108-1, 108-2 while providing a sealed interface between the sleeve 102-1, 102-2 and the glove 108-1, 108-2 to resist or prevent ingress of hazardous materials between the first portion 106 and the second portion 110 (i.e. between the sleeve and the glove). The first portion 106 may be released from the second portion 110 by forcing the first portion 106 and second portion 110 axially away from each other to flex the groove 628 open to release the projection 308.

Figure 8:
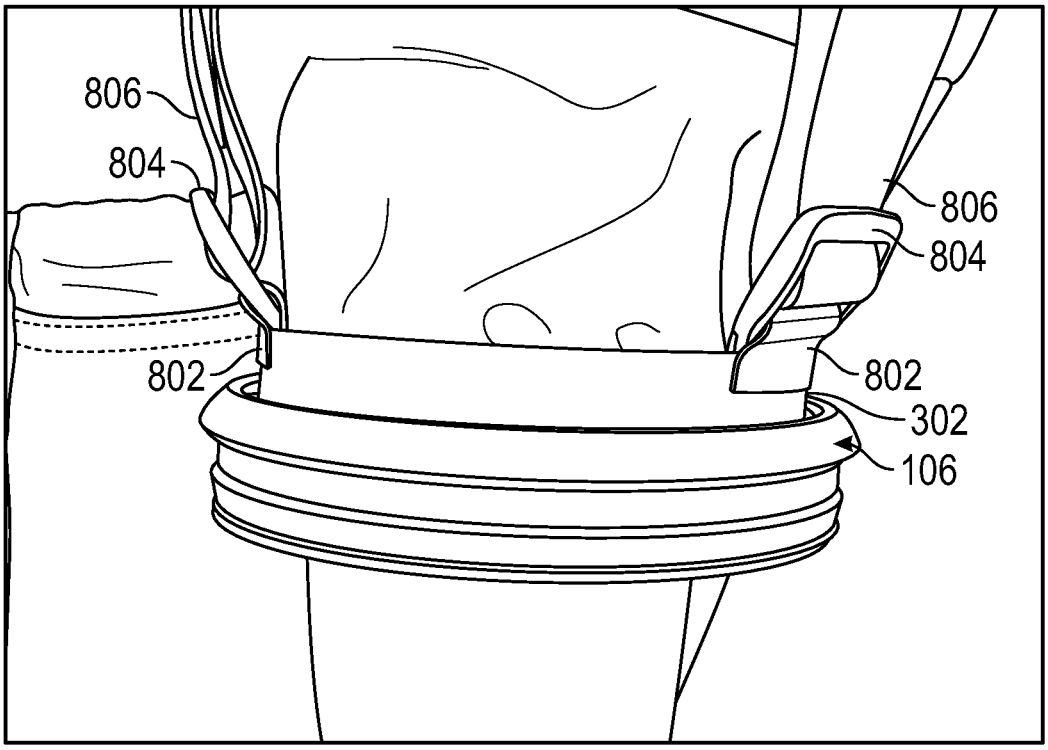
FIGS. 8-11 illustrate an example sequence of coupling a first portion of a seal to a second portion of a seal consistent with the present disclosure.

With reference again to FIG. 1 and also to FIG. 8, the flange 302 of the first portion 106 of the seal may be stitched or bonded to the cuff of the garment 100 and/or may be coupled to the sleeves 102-1, 102-2 by one or more clips and straps. In the illustrated example embodiment, a plurality of clips 802 are bonded the flange 302 of the first portion 106 to retain associated tri-glide clips 804 to the first portion 106. A strap 806 may be positioned through each tri-glide clip 804 for coupling the first portion 106 to the sleeve 102-1, 102-2, e.g., using a hook-and-loop fastener connection.

In the illustrated example, the straps 806 include a hook portion of a hook-and-loop fastener and are positioned in the associated tri-glide clip 804 to couple to a corresponding associated loop portions 112 of a hook-and-loop fastener configuration coupled to the sleeve. In some embodiments, a marker line 114 may be provided on the straps 806 to facilitate alignment of the hook and loop fastener portions. With reference to FIG. 1, for example, the marker line 114 may be provided on the strap 806 and the strap 806 may be positioned in the tri-glide 804 so that the marker line 114 aligns with the upper edge of the tri-glide 804, resulting in the hook portion on the strap 806 mating with the loop portion 112 on the sleeve 102-1, 102-2.

Figure 9:
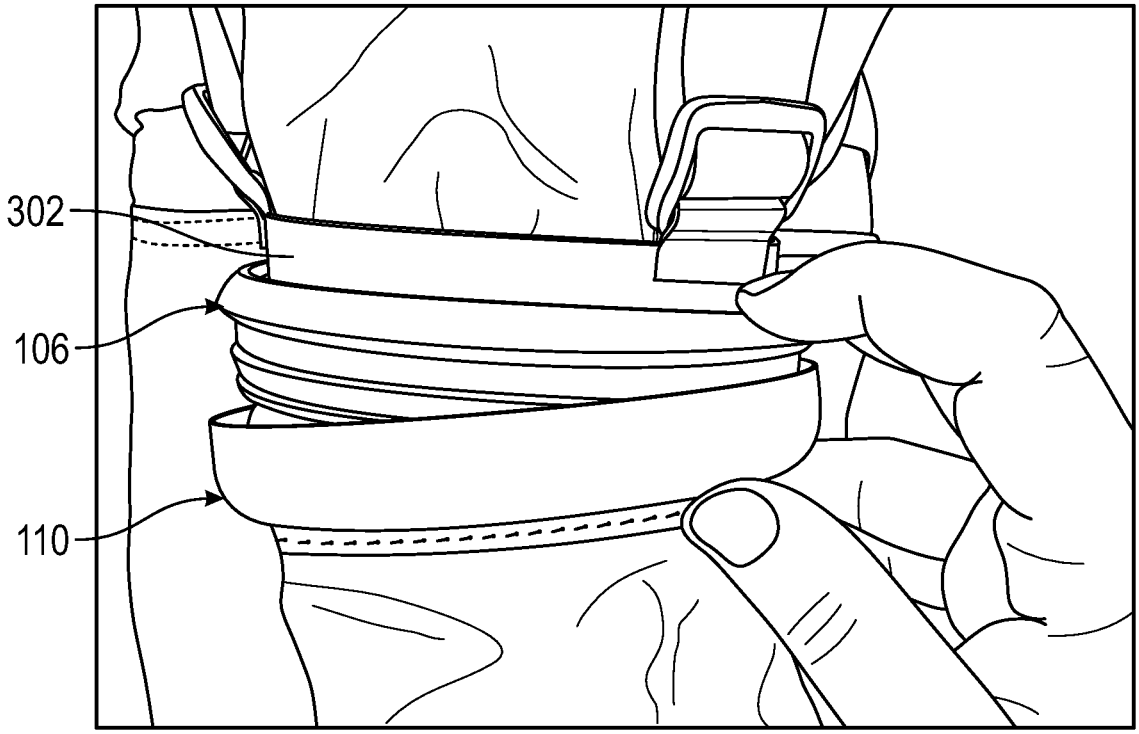
Figure 10:
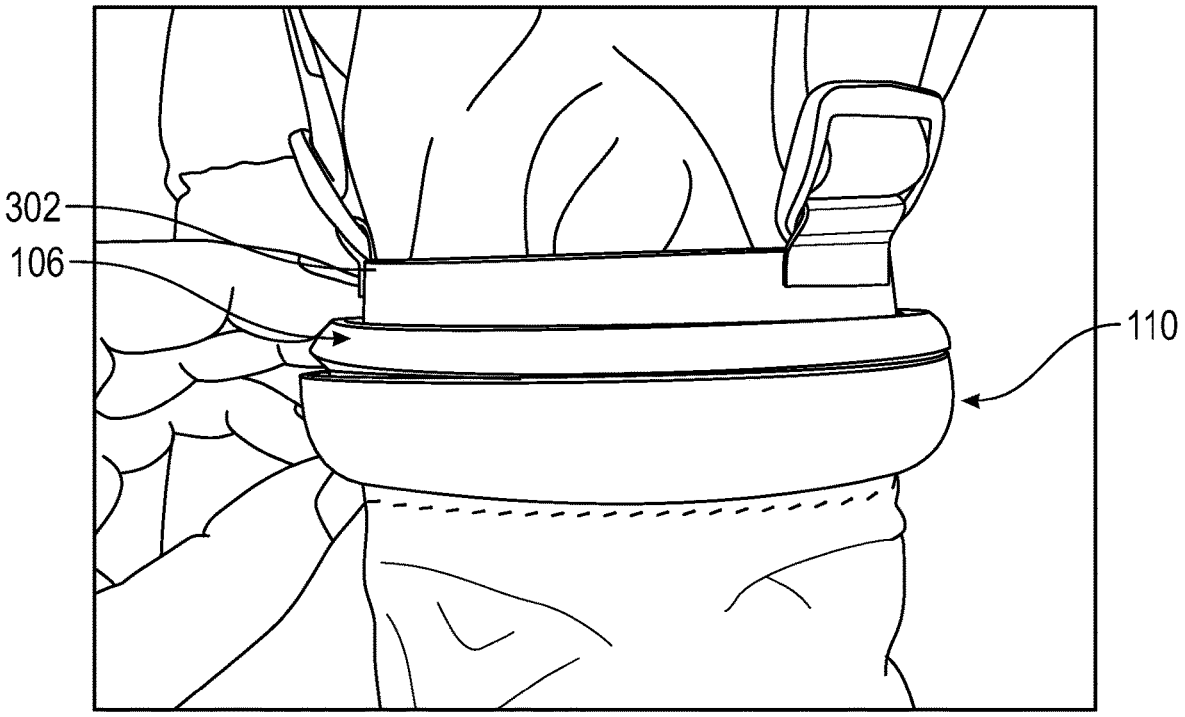
Figure 11:
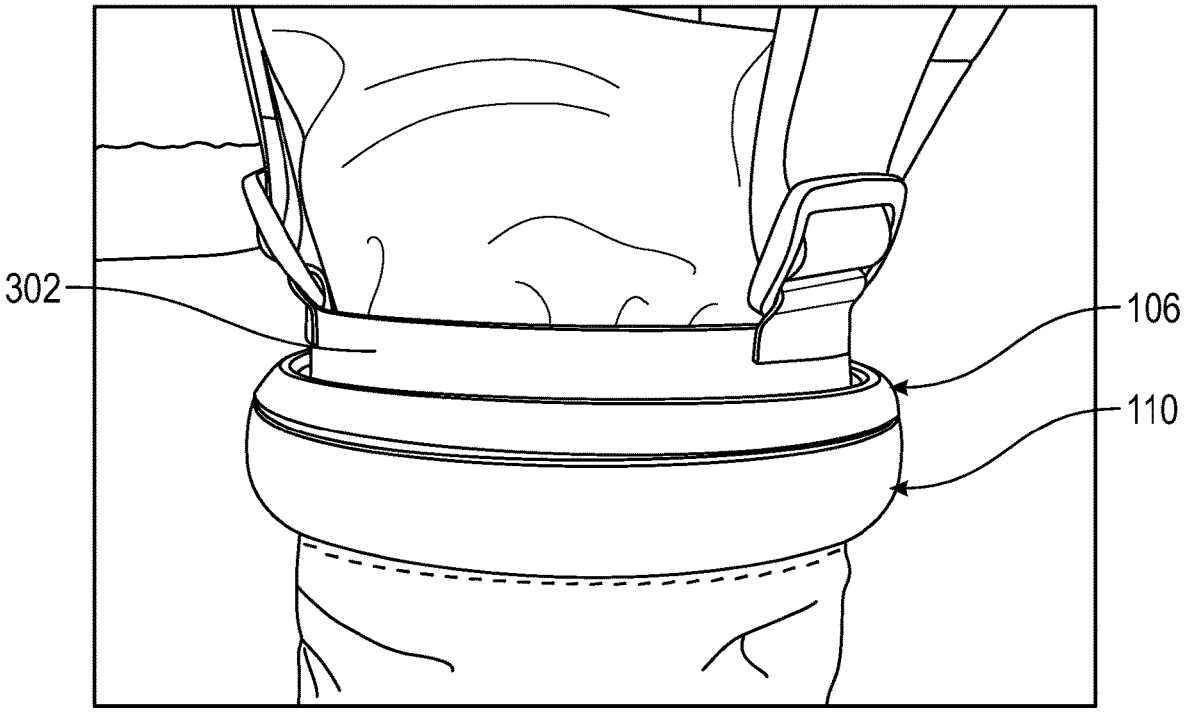

FIGS. 8-11 illustrate a sequence for coupling first portion 106 to the second portion 110. As shown, in FIG. 8, the first portion 106 may be coupled to the cuff of a sleeve 102-1, 102-2, as previously described. The second portion 110, coupled to a glove in the illustrated embodiment, may be aligned with the first portion 106, as shown in FIG. 9, so that the projection 308 on the first portion 106 enters the groove 628 in the second portion 110. As shown in FIG. 10, a user may apply pressure around the perimeter of the seal, e.g. using a thumb and fingers, to force the projection 308 into the groove 628 until the first 106 and second portions 110 snap together. FIG. 11 illustrates the completed seal.

Figure 12:
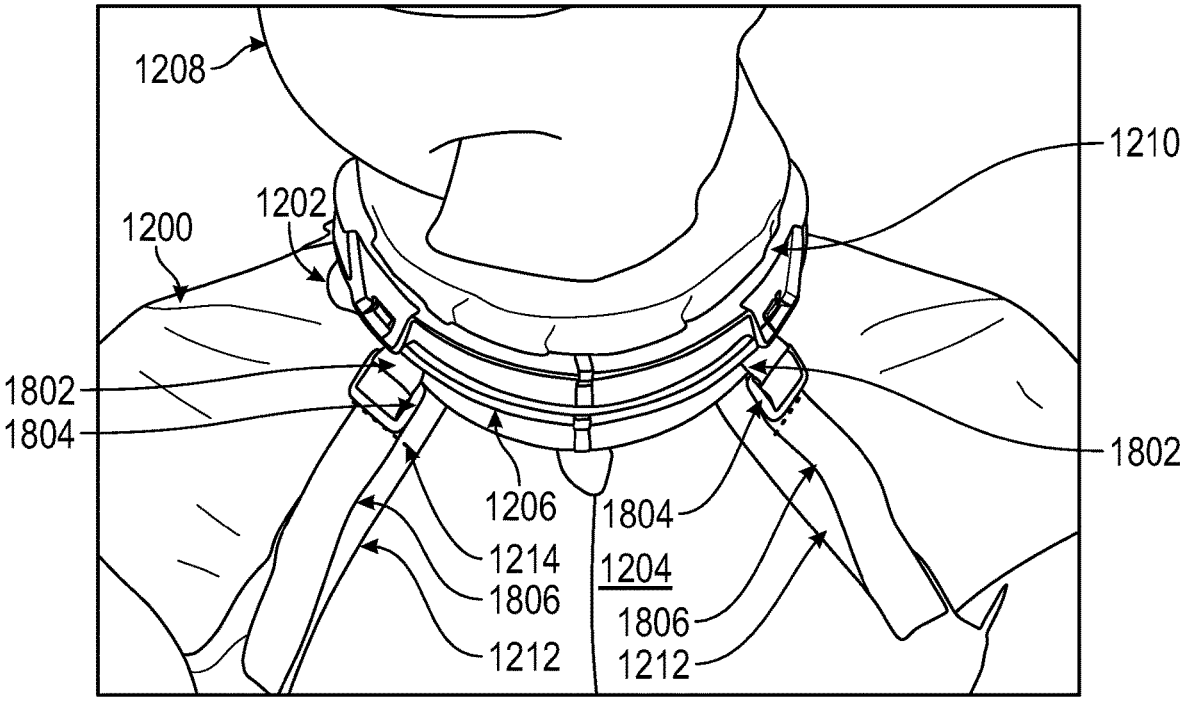
FIG. 12 is a front view of a mannequin wearing a garment with another example of a first portion of a seal consistent with the present disclosure.

Turning to FIG. 12, there is illustrated garment 1200 positioned on a mannequin. The garment is configured as jacket with a collar 1202 and a torso 1204 portion. The collar 1202 has a first portion 1206 of a seal consistent with the present disclosure coupled thereto. A hood 1208 portion has a second portion 1210 of a seal consistent with the disclosure attached thereto. In general, a user wearing the garment 1200 with the first portion 1206 coupled to the collar may don the hood 1208 by coupling the first portion 1206 to the second portion 1210. Coupling of the first 1206 and second 1210 portions provides a seal therebetween to resist or prevent ingress of hazardous materials between the collar 1202 of the garment 1200 and the hood, while allowing facile and selective attachment of the hood 1208 to the garment 1200.

Figure 13:
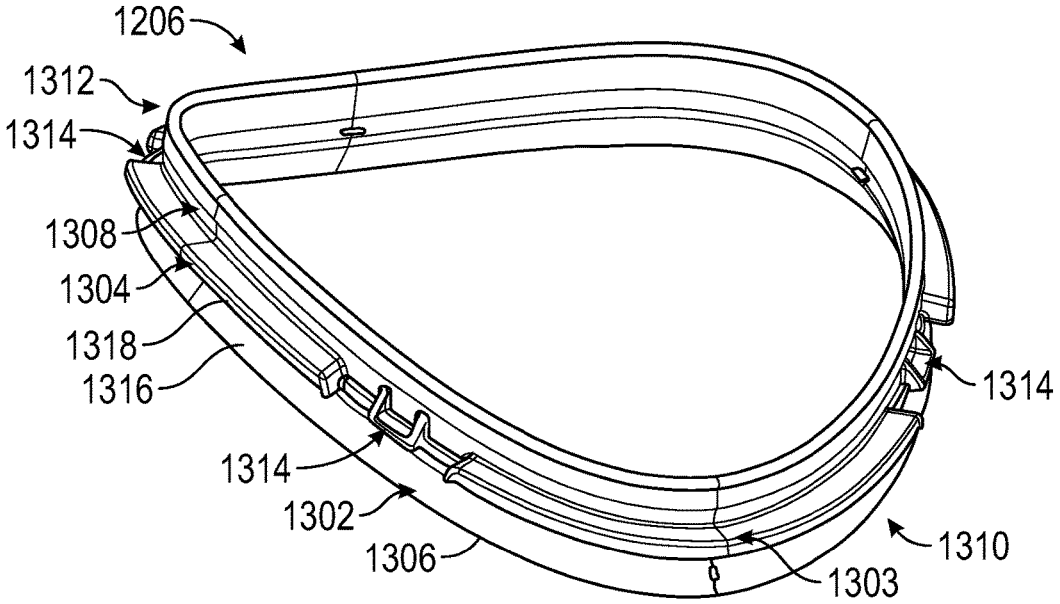
FIG. 13 is a perspective view of the first potion of the seal shown in FIG. 12.

FIG. 13 illustrates one example of the first portion 1206 of the seal shown attached to the collar 1202 of the garment 1200 in FIG. 12. The illustrated example embodiment of the first portion 1206 is generally in the shape of a teardrop and includes a generally inwardly inclined flange 1302, and an extension 1303 extending radially outward from the flange 1302 and including shelf portion 1304 extending from an upper portion of the flange 1302, and a projection 1308 extending upward from the shelf 1304. The flange 1302 is configured to interface with the collar 1202 of the garment 1200 and may be sewn or bonded to the collar 1202. The first portion 1206 may have a bottom surface 1306 that arcs from a wider front 1310 of the first portion 1306 to be positioned at the front of a user to a narrower back 1312 of the first portion 1306 (e.g. as shown in FIG. 15) to be positioned at the back of a user to accommodate a curvature associated with a user's shoulders.

Figure 14:
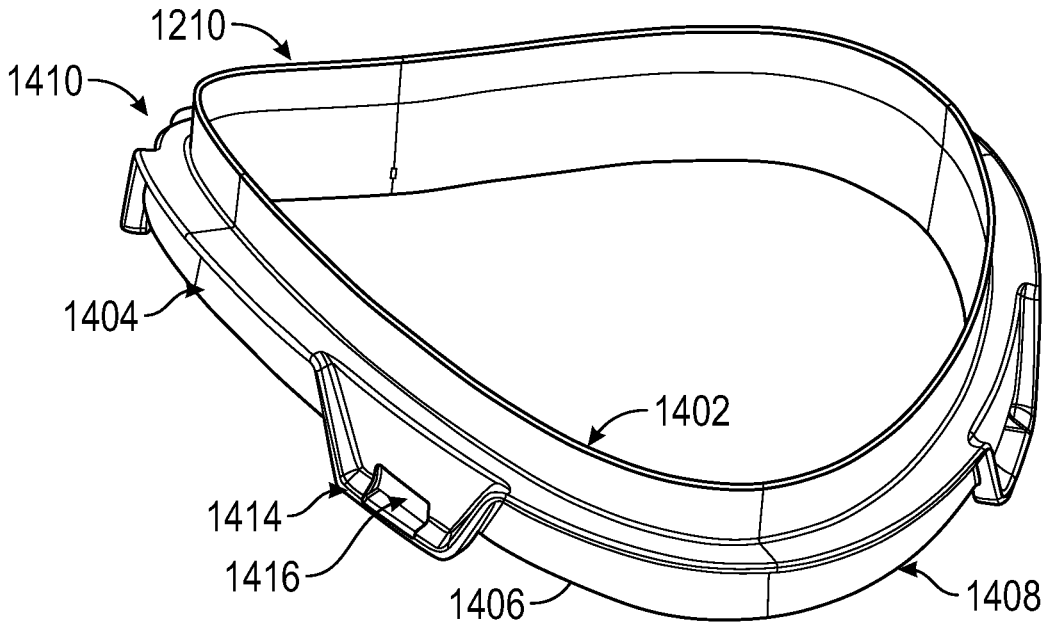
FIG. 14 is perspective of a second portion of the seal shown in FIG. 12.

FIG. 14 illustrates one example of the second portion 1210 of the seal shown attached to the hood 1208 in FIG. 12. The illustrated example embodiment of the second portion 1210 includes a flange 1402 and an extension 1404 extending radially outwardly from the flange 1402. The flange 1404 is configured to interface with the opening hood 1208 as shown in FIG. 12 and may be sewn or bonded to the hood 1208 at the opening thereof. The extension 1404 defines a groove, as will be described herein, for receiving the projection 1308 of the first portion 1206. The first 1206 and second 1210 portions may be each be constructed of a resilient material, such as plastic or rubber. The second portion 1210 may have a bottom surface 1406 that arcs from a front 1408 of the second portion 1210 to be positioned at the front of a user to a back 1410 of the second portion 1210 (e.g., as shown in FIG. 15) to be positioned at the back of a user to accommodate a curvature associated with a user's shoulders.

Figure 15:
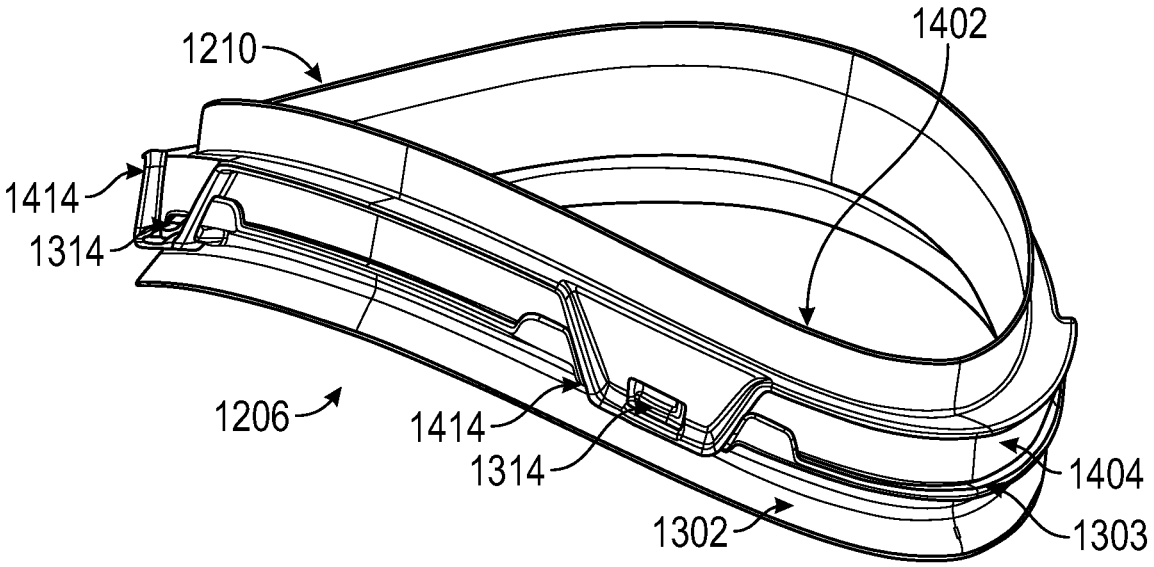
FIG. 15 is perspective of one example of a completed seal consistent with the present disclosure.

With reference also to FIG. 15, the first portion may also include a plurality of catches 1314 for coupling with an associated retainers 1414 on the second portion 1210. In the illustrated example, each of the catches 1314 is provided in an interruption in the shelf 1304 of the first portion 1206 and projects outwardly from the exterior surface 1316 of the flange 1304 but still inward from an external surface 1318 of the shelf. Each of the retainers 1414 is defined by portions of the extension 1404 extending downwardly beyond the bottom surface 1406 of the second portion 1210. Each retainer 1414 on the second portion 1210 includes portions defining an opening 1416 for releasably receiving an associated catch 1314 on the first portion 1206 to releasably retain the first portion 1206 to the second portion 1210.

Figure 16:
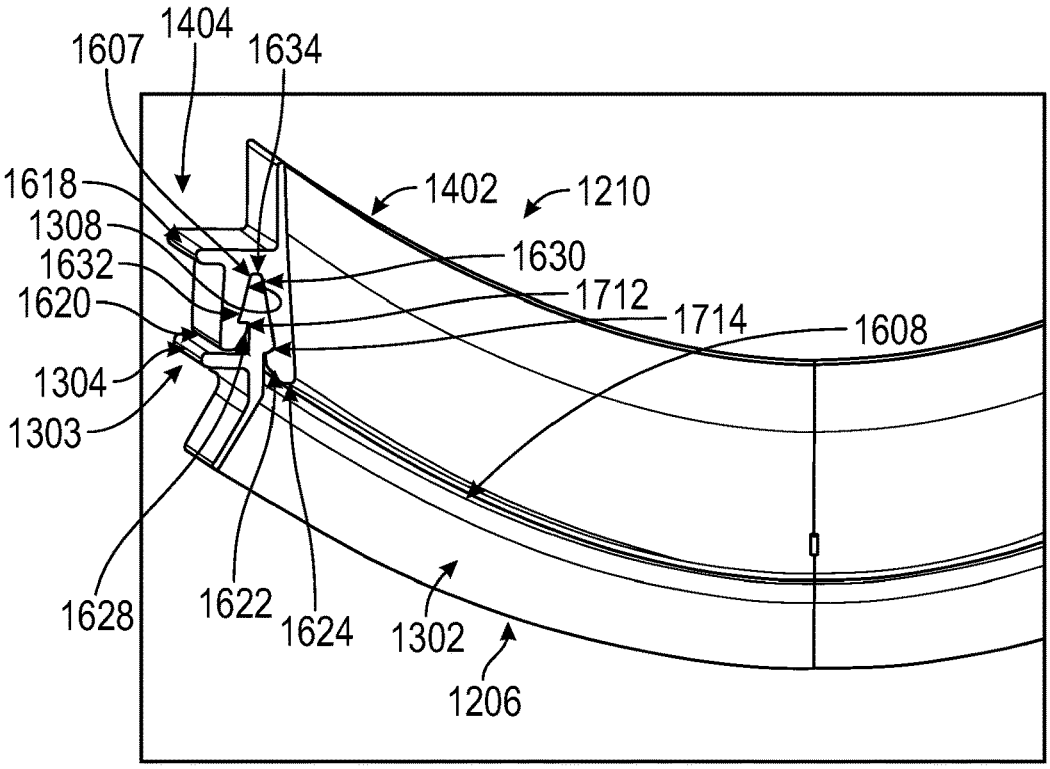
FIG. 16 is perspective sectional view of the seal shown in FIG. 15.
Figure 17:
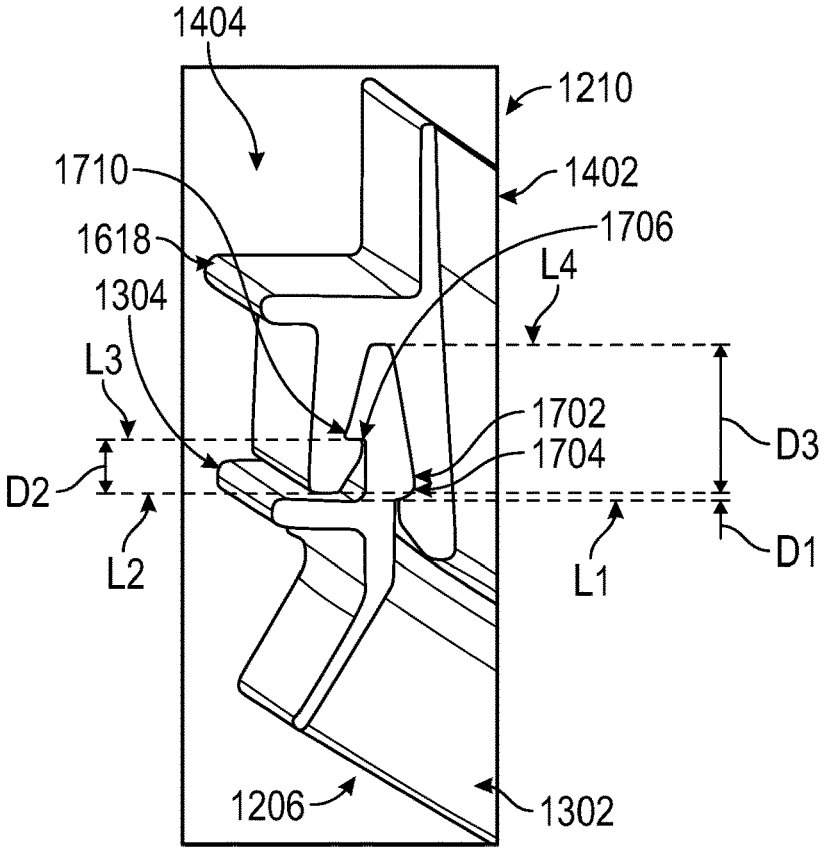
FIG. 17 is detailed view of a portion of FIG. 16.

FIG. 16 is a partial cut away view of the first 1206 and second 1210 portions of the seal in an assembled and sealed configuration. FIG. 17 is a detailed view of a portion of the seal shown in FIG. 16. In the illustrated example, the flanges 1302, 1402 of the first 1206 and second 1210 portions have generally the same internal dimension. The shelf 1304 extends outwardly from an upper portion of the flange 1302. The projection 1308 extends upwardly from the shelf 1304, e.g., in a direction generally parallel to a central axis of the first portion 1210 and terminates in a tip 1607. In the illustrated example the tip 1607 is configured as a rounded bead. The projection 1308 is spaced from an upper rim 1608 of the flange 1302 define a shoulder.

The extension 1404 of the second portion 1210 extends radially from the flange 1402 to a rim 1618 and then inwardly and down to a bottom 1620 that rests on and in opposed facing relationship to the shelf 1304. The extension 1404 includes an outer surface 1622 extending downwardly to a tip 1624. The tip 1624 is positioned in opposed facing relationship to the upper rim 1608 of the first portion 1206.

The extension 1404 further includes a groove 1628 defined between first 1630 and second 1632 interior walls that meet at a rounded end 1634. The projection 1308 of the first portion 1206 extends upwardly then radially inward from an interior surface of the projection 308 to a tip 1702 of a first shoulder 1704. In the illustrated embodiment, the tip 1702 of the first shoulder 1704 is positioned at a distance D1 measured from a first line L1 parallel with a top surface of the shelf 1304 and a second line L2 parallel to the first line L1 and intersecting a bottom of the tip 1702. A second shoulder 1706 extends radially outward from an exterior surface of the projection 1308 to a tip 1710. The tip 710 of the second shoulder 1706 is positioned at a distance D2 measured from the first line L1 parallel to a third line L3 parallel to the first line L1 and intersecting a bottom of the tip 1710. The distance D2 is greater than the distance D1.

From the tips 1702 and 1710 the interior surface and the exterior surface of the projection converges to the tip 1607 of the projection 1308. The base of the tip 1607 of the projection is positioned at a distance D3 measured from the first line L1 parallel to a fourth line L4 parallel to the first line L1 and intersecting a base of the tip 1607. The distance D3 is greater than the distance D1 and the distance D2.

Referring still to both FIGS. 16 and 17, the first interior wall 1630 of the groove defines a first shelf 1712 and the second interior wall defines a second shelf 1714. The first 1712 and second 1714 shelves are positioned to be in contact with and in opposed facing relationship to the first 1704 and second 1706 shoulders of the projection, respectively, 1308 when the projection 1308 is disposed in the groove 1628 with the tip 1607 of the projection 1308 disposed in opposed facing relationship and in contact with the rounded end 1634 of the groove 1628. With this configuration, the projection 1308 may be inserted into the groove 1628 with the projection engaging and pushing against the interior walls of the groove 1628 to open the groove 1628 for receiving the projection 1308. When the tip of 1607 of the projection is positioned against the rounded end 1634 of the groove 1628, the groove 1628 flexes inward to position the shelves 1712, 1714 against the shoulders 1706,1704, respectively, to releasably hold the projection 1308 in the groove 1628. This first portion 1206 and the second portion 1210 thus allow selective attachment of the hood 1208 to the collar 1202 while providing a sealed interface between the hood 1208 and the collar 1202 to resist or prevent ingress of hazardous materials between the first portion 1206 and the second portion 1210 (i.e., between the collar and the hood). The first portion 1206 may be released from the second portion 1210 by forcing the first portion 1206 and second portion 1210 axially away from each other to flex the groove 1628 open to release the projection 1308.

Figure 18:
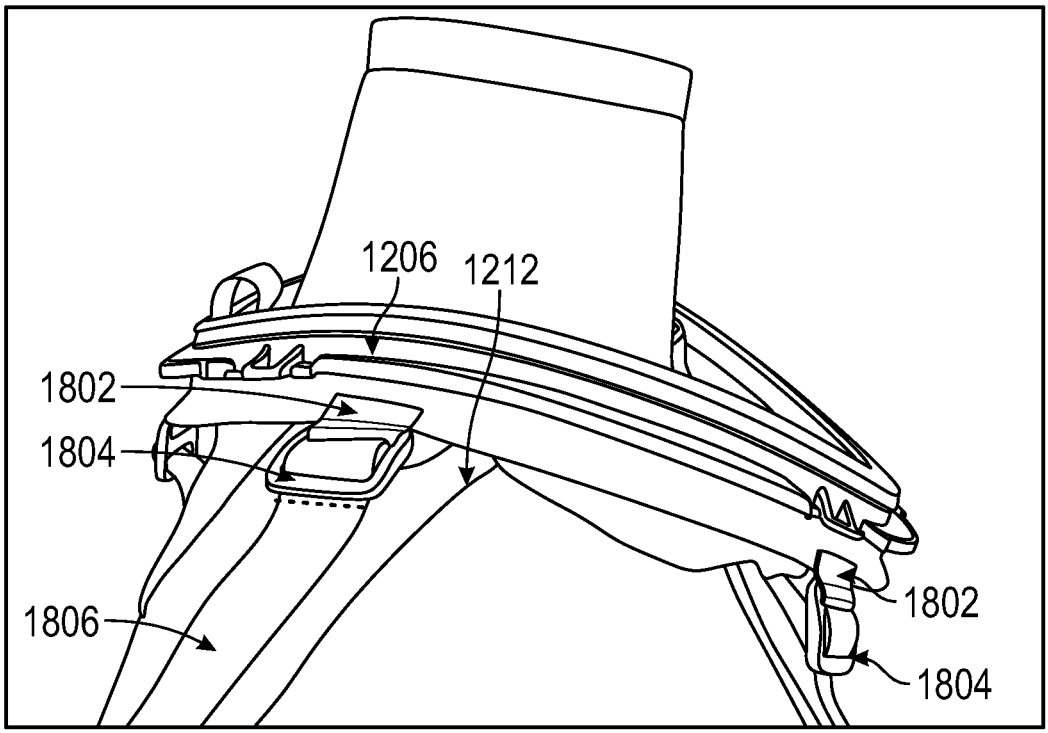
FIGS. 18-20 illustrate another example sequence of coupling a first portion of a seal to a second portion of a seal consistent with the present disclosure.

With reference again to FIG. 12 and also to FIG. 18, the flange 1302 of the first portion 1106 of the seal may be stitched or bonded to the collar the garment 1200 and/or may be coupled to the garment 1200 by one or more clips and straps. In the illustrated example embodiment, a plurality of clips 1802 are bonded the flange 1302 of the first portion 1206 to retain associated tri-glide clips 1804 to the first portion 1206. A strap 1806 may be positioned through each tri-glide clip 1804 for coupling the first portion 1206 to the garment 1200, e.g., using a hook-and-loop fastener connection.

In the illustrated example, the straps 1806 include a hook portion of a hook-and-loop fastener and are positioned in the associated tri-glide clip 1804 to couple to a corresponding associated loop portions 1212 of a hook-and-loop fastener configuration coupled to the garment. In some embodiments, a marker line 1214 may be provided on the straps 1806 to facilitate alignment of the hook and loop fastener portions. With reference to FIG. 1, for example, the marker line 1214 may be provided on the strap 1806 and the strap 1806 may be positioned in the tri-glide 1804 so that the marker line 1214 aligns with the upper edge of the tri-glide 1804, resulting in the hook portion on the strap 1806 mating with the loop portion 1212 on the garment 1200.

Figure 19:
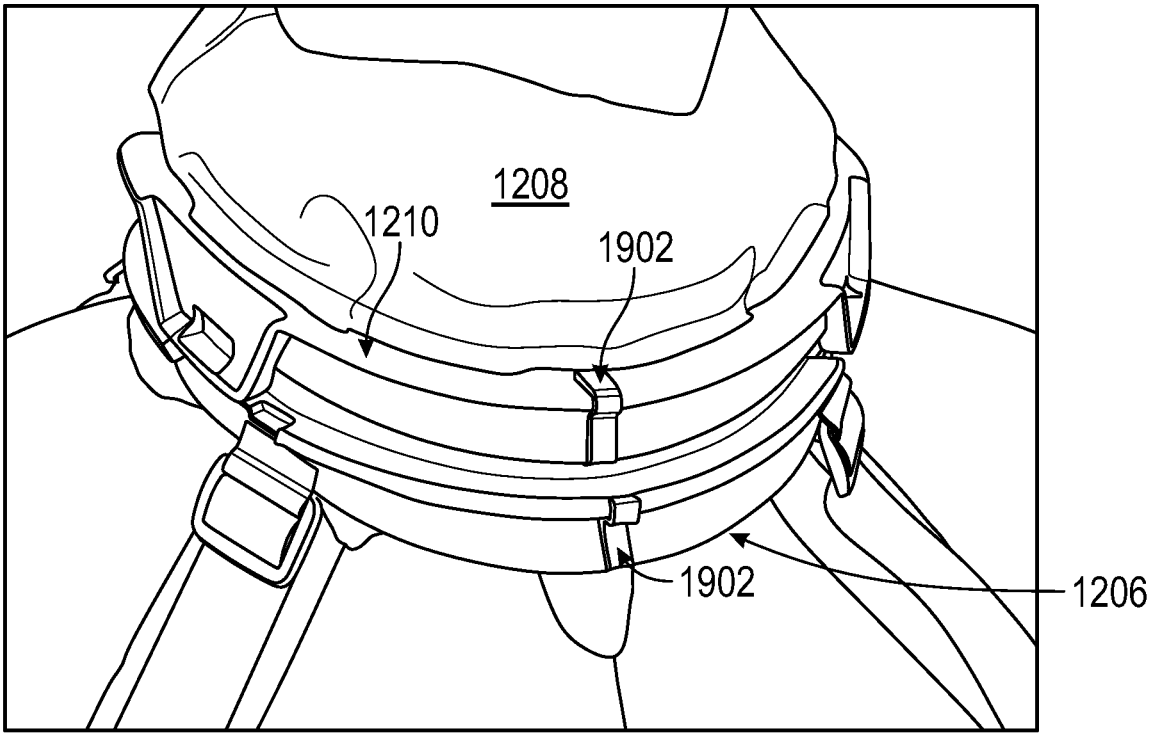
Figure 20:
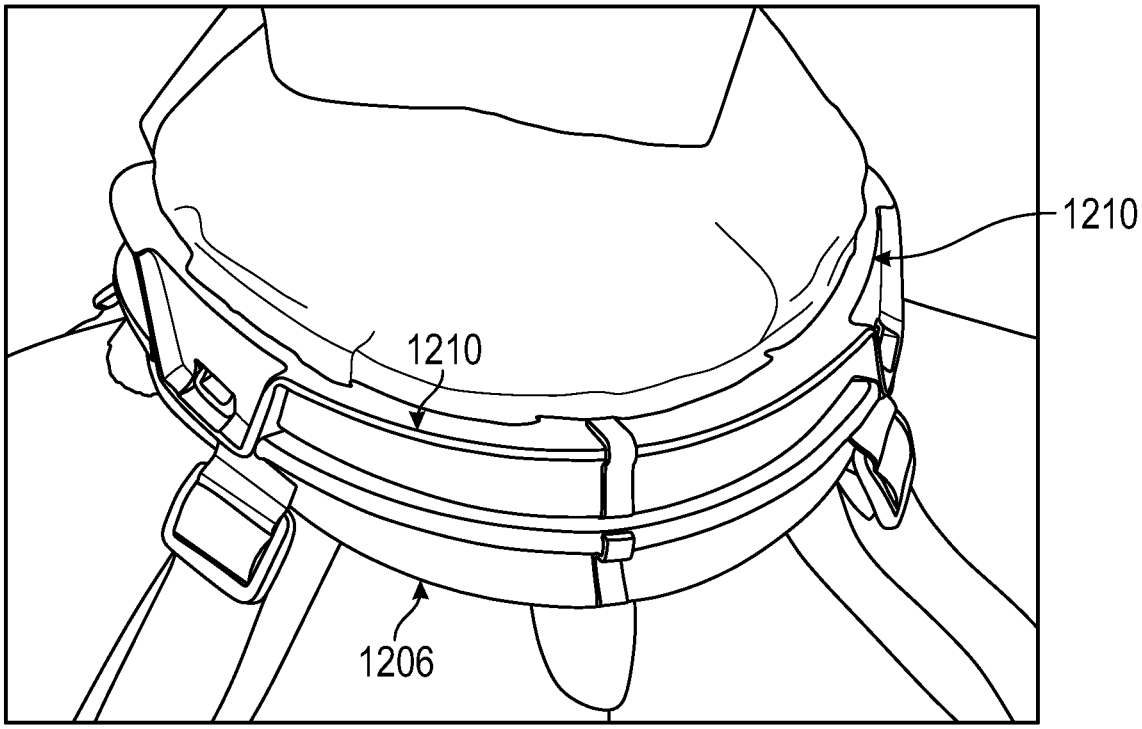

FIGS. 18-21 illustrate a sequence for coupling first portion 1206 to the second portion 1210. As shown, in FIG. 18, the first portion 1206 may be coupled collar 1202 of the garment 1200, as previously described. The second portion 1210, coupled to a hood 1208 in the illustrated embodiment, may be aligned with the first portion 1206, as shown in FIG. 19, so that the projection 1308 on the first portion 1206 enters the groove 1628 in the second portion 1210. Molded ribs or markers 1902 may be placed on the first 1206 and second 1210 portions at positions where first 1206 and second 1210 portions are aligned to assist the user in alignment. A user may apply pressure around the perimeter of the seal, e.g., using a thumb and fingers, to force the projection 1308 into the groove 1628 until the first 1206 and second portions 1210 and the catches 1314 and retainers 1414 snap together. FIG. 20 illustrates the completed seal.

According to one aspect of the present disclosure, there is thus provided a selectively attachable garment-to-appendage interface. The interface includes a seal having a first portion to a garment and a second portion coupled to an appendage such as a glove, a hood or footwear. The first portion includes one of a projection or a groove. The second portion includes the other of the projection or a groove. The projection and the groove are configured to releasably engage for selectively attaching the garment to the appendage.

In some embodiments, the appendage is a glove and the first portion is coupled to a cuff of the garment. In some embodiments, the appendage is a hood and the first portion is coupled to a collar of the garment. In some embodiments, the projection includes first and second shoulders configured to engage first and second shoulders in the groove in opposed facing relationship.

According to another aspect of the disclosure, there is provided a selectively attachable garment-to-appendage interface. The interface includes: a first portion including a first portion flange configured to be coupled to one of a garment or an appendage, and a first portion extension extending radially outward from the first portion flange and including a projection; and a second portion including a second portion flange configured to be coupled to the other of the garment or the appendage, and a second portion extension extending radially outward from the second portion flange and including first and second interior walls defining a groove. The projection is configured to be inserted into the groove and engage the first and second interior walls for selectively attaching the garment to the appendage and providing a seal to resist ingress of materials between the garment and the appendage.

According to another aspect of the disclosure, there is provided another selectively attachable garment-to-appendage interface. The interface includes: a first portion including a first portion flange configured to be coupled to one of a garment or an appendage, and a first portion extension extending radially outward from the first portion flange and including a projection, the projection including first and second shoulders and a tip configured as a rounded bead; and a second portion including a second portion flange configured to be coupled to the other of the garment or the appendage, and a second portion extension extending radially outward from the second portion flange and including first and second interior walls defining a groove, the groove comprising first and second shelves configured to contact the first and second shoulders of the projection in opposed facing relationship. The projection is configured to be inserted into the groove and engage the first and second interior walls for selectively attaching the garment to the appendage and providing a seal to resist ingress of materials between the garment and the appendage. The interface further includes at least one strap coupled to the first portion for coupling the first portion to the one of the garment or the appendage.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. The terms "connected" or "coupled" as used herein is a relative term and does not require a direct physical connection, unless otherwise stated.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Although the methods and systems have been described relative to a specific embodiment thereof, they are not so limited. Obviously, many modifications and variations may become apparent in light of the above teachings. Many additional changes in the details, materials, and arrangement of parts, herein described and illustrated, may be made by those skilled in the art.

What is claimed is:

1. A selectively attachable garment-to-appendage interface comprising:

a first portion comprising:

a first portion flange configured to be coupled to one of a garment or an appendage, and a first portion extension extending radially outward from the first portion flange and comprising a projection extending axially from the first portion extension to be positioned radially outward from the first portion flange, the projection comprising first and second shoulders, the first shoulder extending radially inward from an interior surface of the projection to a first tip, the first tip being positioned at a first distance, D1, from a line, L1, parallel with a radius of the first portion and intersecting a bottom of the projection, and the second shoulder extending radially outward from an exterior surface of the projection to a second tip positioned at a second distance, D2, from the line L1, wherein the second distance D2 is greater than the first distance D1; and a second portion comprising:

a second portion flange configured to be coupled to the other of the garment or the appendage, and a second portion extension extending radially outward from the second portion flange and comprising first and second interior walls defining a groove positioned radially outward from the second portion extension flange;

the projection being configured to be inserted into the groove and engage the first and second interior walls for selectively attaching the garment to the appendage and providing a seal to resist ingress of materials between the garment and the appendage.

2. The selectively attachable garment-to-appendage interface according to claim 1, wherein the first interior wall defines a first shelf and the second interior wall defines a second shelf, and wherein the first and second shoulders are configured to contact and be in opposed facing relationship with the first shelf and second shelf, respectively.

3. The selectively attachable garment-to-appendage interface according to claim 1, wherein the projection comprises a tip configured as a rounded bead.

4. The selectively attachable garment-to-appendage interface according to claim 1, wherein first portion extension comprises an arm extending radially outward from an upper portion of the first portion flange to a base to define an inner groove between the first portion extension and the first portion flange, and wherein a portion of the second portion extension is configured to be received in the inner groove.

5. The selectively attachable garment-to-appendage interface according to claim 4, wherein the base extends radially outward from a bottom of the projection to define a shoulder, and wherein a portion of the second portion extension is configured to be positioned in opposed facing relationship to the shoulder when the projection is disposed in the groove.

6. The selectively attachable garment-to-appendage interface according to claim 1, wherein the first portion flange and the second portion flange are generally cylindrical.

7. The selectively attachable garment-to-appendage interface according to claim 1, wherein an interior surface of the first portion flange is configured to be substantially aligned with an interior surface of the second portion flange when the projection is disposed in the groove.

8. The selectively attachable garment-to-appendage interface according to claim 1, the system further comprising at least one strap coupled to the first portion for coupling the first portion to the one of the garment or the appendage.

9. The selectively attachable garment-to-appendage interface according to claim 1, wherein first portion extension comprises a shelf portion extending from an upper portion of the first portion flange and wherein the projection extends axially from the shelf portion, and wherein a portion of the second portion extension is configured to rest in opposed facing relationship on the shelf portion.

10. The selectively attachable garment-to-appendage interface according to claim 1, wherein the first portion comprises a plurality of catches configured to couple with associated retainers of the second portion.

11. The selectively attachable garment-to-appendage interface according to claim 1, wherein the first portion flange is inwardly inclined.

12. The selectively attachable garment-to-appendage interface according to claim 1, wherein the first portion and the second portion have a generally teardrop shape with a wider front portion and a narrower back portion.

13. A selectively attachable garment-to-appendage interface comprising:

a first portion comprising:

a first portion flange configured to be coupled to one of a garment or an appendage, and a first portion extension extending radially outward from the first portion flange and comprising a projection extending axially from the first portion extension to be positioned radially outward from the first portion flange, the projection comprising first and second shoulders and a tip configured as a rounded bead, the first shoulder extending radially inward from an interior surface of the projection to a first tip, the first tip being positioned at a first distance, D1, from a line, L1, parallel with a radius of the first portion and intersecting a bottom of the projection, and the second shoulder extending radially outward from an exterior surface of the projection to a second tip positioned at a second distance, D2, from the line L1, wherein the second distance D2 is greater than the first distance D1;

a second portion comprising:

a second portion flange configured to be coupled to the other of the garment or the appendage, and a second portion extension extending radially outward from the second portion flange and comprising first and second interior walls defining a groove, the groove positioned radially outward from the second portion extension flange and comprising first and second shelves configured to contact the first and second shoulders of the projection in opposed facing relationship;

the projection being configured to be inserted into the groove and engage the first and second interior walls for selectively attaching the garment to the appendage and providing a seal to resist ingress of materials between the garment and the appendage; and at least one strap coupled to the first portion for coupling the first portion to the one of the garment or the appendage.

14. The selectively attachable garment-to-appendage interface according to claim 13, wherein first portion extension comprises an arm extending radially outward from an upper portion of the first portion flange to a base to define an inner groove between the first portion extension and the first portion flange, and wherein a portion of the second portion extension is configured to be received in the inner groove.

15. The selectively attachable garment-to-appendage interface according to claim 14, wherein the base extends radially outward from a bottom of the projection to define a shoulder, and wherein a portion of the second portion extension is configured to be positioned in opposed facing relationship to the shoulder when the projection is disposed in the groove.

16. The selectively attachable garment-to-appendage interface according to claim 13, wherein the first portion flange and the second portion flange are generally cylindrical.

17. The selectively attachable garment-to-appendage interface according to claim 13, wherein an interior surface of the first portion flange is configured to be substantially aligned with an interior surface of the second portion flange when the projection is disposed in the groove.

18. The selectively attachable garment-to-appendage interface according to claim 13, wherein first portion extension comprises a shelf portion extending from an upper portion of the first portion flange and wherein the projection extends axially from the shelf portion, and wherein a portion of the second portion extension is configured to rest in opposed facing relationship on the shelf portion.

19. The selectively attachable garment-to-appendage interface according to claim 13, wherein the first portion comprises a plurality of catches configured to couple with associated retainers of the second portion.

20. The selectively attachable garment-to-appendage interface according to claim 13, wherein the first portion and the second portion have a generally teardrop shape with a wider front portion and a narrower back portion.

* * * * *